United States Patent [19]

Kidd

[11] 4,010,665

[45] Mar. 8, 1977

[54] MOBILE SAW BENCH FOR FARM USE AND THE LIKE

[76] Inventor: Archibald Watson Kidd, Seend Close, Seend, Melksham, Wiltshire, England

[22] Filed: Dec. 2, 1974

[21] Appl. No.: 528,898

[30] Foreign Application Priority Data

Dec. 10, 1973 United Kingdom ..... 57050/73

[52] U.S. Cl. ..... 83/477.2; 83/928; 83/701; 241/101.7

[51] Int. Cl.[2] ..... B27B 5/10

[58] Field of Search ..... 83/471, 928, 477.2, 83/701; 241/101.7

[56] References Cited

UNITED STATES PATENTS

| | | | |
|---|---|---|---|
| 2,477,794 | 8/1949 | Gehl | 241/101.7 X |
| 2,478,123 | 8/1948 | Richey | 83/928 X |
| 2,536,910 | 1/1951 | Cook et al. | 83/928 X |
| 2,719,549 | 10/1955 | Hemshrodt | 83/928 X |

*Primary Examiner*—Donald R. Schran

*Attorney, Agent, or Firm*—Larson, Taylor and Hinds

[57] ABSTRACT

Mobile saw bench having at the front means for attachment to the three point linkage of an agricultural tractor and at the rear means for attachment to a trailer, whereby a tractor, the saw bench and a tractor can form a train of machines which can move intact, with the saw bench lifted off the ground while still between the tractor and trailer.

8 Claims, 4 Drawing Figures

MOBILE SAW BENCH FOR FARM USE AND THE LIKE

This invention relates to a mobile saw bench and to equipment incorporating this.

Very many farms have a saw bench of sorts so that waste timber about the farm can be sawn into logs for domestic fuel. To some extent also these benches are used for making posts for fencing and other similar odd jobs. Earlier saw benches were static and fairly heavy pieces of equipment arranged for pulley drive from any convenient power source. Later, saw benches began to be fitted with suitable attachment points to enable them to go on to the 3 point linkage of an ordinary farm tractor so that the tractor could carry the bench around the farm as well as provide the drive.

The disadvantage of these mobile saw benches is that although superior to anything that had gone before, they still left it necessary, in the case of cutting up timber for logs or similar work, to have a separately drawn trailer taken to the scene of operations to bring home the logs, posts or whatever, thus frequently necessitating the use of a second man and a second tractor.

According to this invention I provide a mobile saw bench having at the front means for attachment to the three point linkage of a tractor and at the rear means for attachment to a trailer. Preferably the means for attachment to the tractor is located off centre at the front of the bench and the rear attachment means is located at the rear of the bench opposite to the first attachment means.

According to a second aspect of the invention I provide an equipment for sawing and transporting wood comprising a train of machines in which a tractor, a saw bench, and a trailer are connected one to the next in that order, means being provided for raising the saw bench above the ground and lowering it to the ground while the trailer is connected thereto whereby the train can move with the saw bench in a raised position between the tractor and trailer.

One piece of equipment made according to this invention is illustrated in the accompanying drawing wherein.

Figure 1:
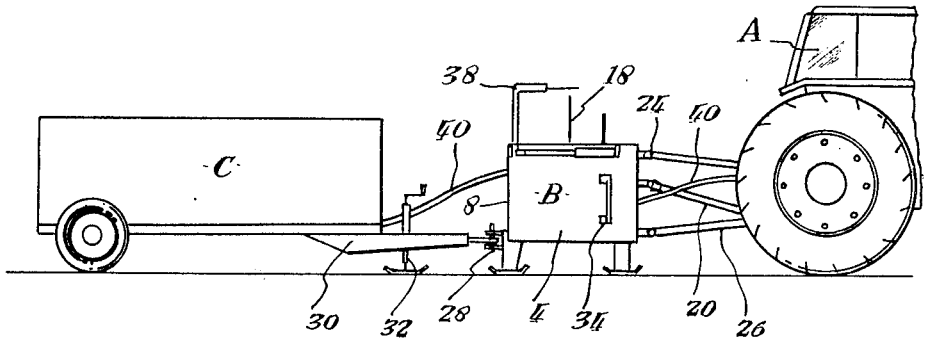
FIG. 1 is a side view of a saw bench and trailer in the stationary or working position.

Referring to the drawing the tractor A, saw bench B and trailer C are connected one to the next so as to form a train for transport. The saw bench B is rectangular in plan with a flat smooth working surface 2 supported by a substantial body 4 having a front wall 6 rear wall 8 and side walls 10, 12, the wall 12 being inclined inwards towards the ground. The body 4 is provided with feet 14 having large flat treads so that the weight of the bench will not cause them to sink into soft ground. The bench has a saw blade 18 driven from the power take off shaft 20 of the tractor through drive means 22. The front of the body 2 is provided with attachment points 24 for connection to the three point linkage 26 of the tractor. The back of the body 2 is provided with a hitch point 28 having a pair of aligned apertures for attachment of the draw bar 30 of the trailer by means of a hitch pin. The draw bar 30 of the trailer may also be provided with a foot 32 and means may be provided for raising and lowering the foot 32 as required. The hitch point 28 may be a clevis or a ring or alternatively a pick-up hook so that a ring hitch trailer can be used.

The blade 18 is provided with a brake 34 operable by a lever projecting from wall 10 of the body and the top of the bench is further provided with a fence 36 and a guard 38 as is usual with saw benches.

As will be seen from the drawing the saw bench projects one side slightly beyond the width of the tractor so that a long piece of cordwood can be offered up to the saw blade 18 without difficulty. If desired means may be provided on the saw bench for sliding or hinging back the bench and blade portions that project beyond the width of the tractor so that during transit the saw bench lies effectively inside the width of the rest of the train.

An hydraulic pipe 40 operable from the driver's seat leads to the trailer C through the body of the bench B.

Figure 2:
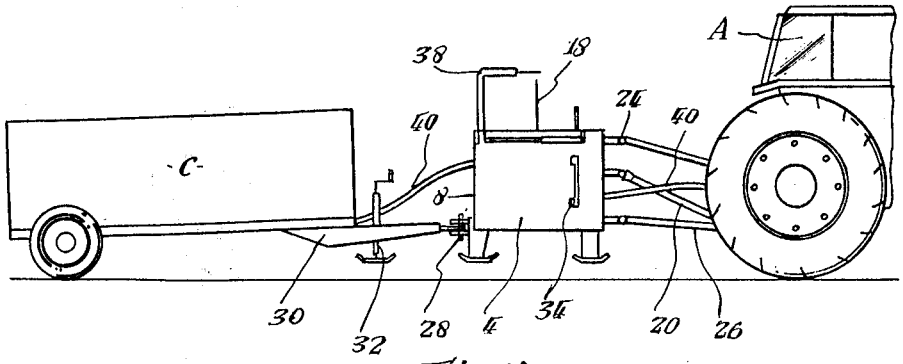
FIG. 2 shows the same piece of equipment in the transport position.
Figure 3:
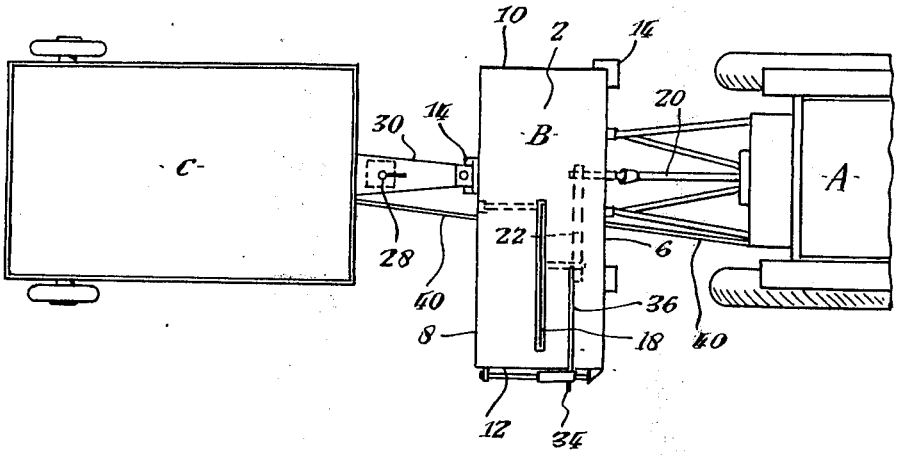
FIG. 3 is a plan view.
Figure 4:
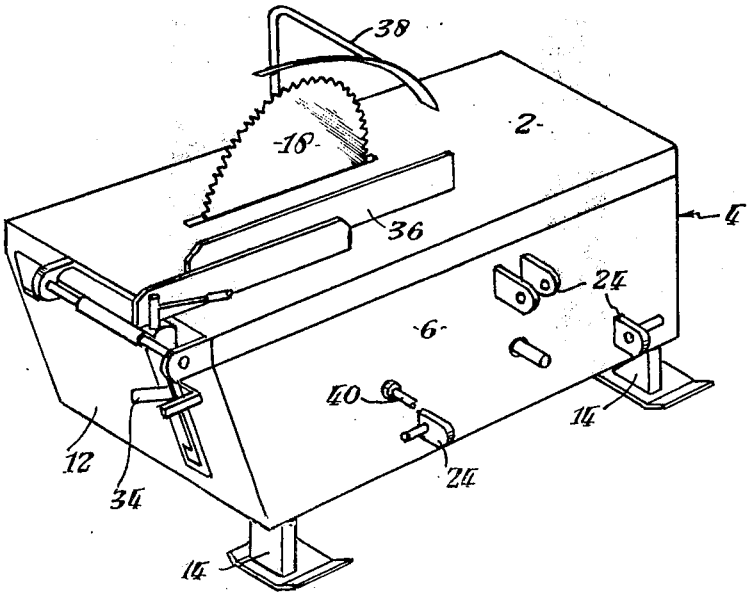
FIG. 4 is a perspective view of the saw bench, showing the points for connection to the tractor.

In use, the train in the position shown in FIG. 2 is pulled by the tractor to the place where it is desired to cut the wood. When it is desired to use the saw bench the tractor driver lowers the bench onto the ground into the position shown in FIG. 1, at which time the sawing operation is carried out and the trailer filled. When the job has been completed the tractor driver lifts the saw bench clear of the ground. The trailer will tip slightly owing to the raised position of the saw bench whereupon the train can be driven away. When in store, the tractor can be disengaged from the saw bench and trailer, and used for another purpose, and of course the trailer can also be disconnected.

I claim:

1. Equipment for sawing and transporting wood comprising a train of machines, said train comprising a tractor, a saw bench and a trailer connected one to the next in that order, said saw bench having feet firmly engaging the ground in its lowered position, at which position its upper surface is in position to receive a piece of wood for cutting thereof, said tractor having raising means including a three point linkage connecting the tractor to the front of said saw bench for raising said saw bench above the ground and lowering it to the ground while the trailer is connected to the rear of the saw bench with its wheels engaging the ground such that the train can move with the saw bench and hence also the saw bench feet in a raised position between the tractor and trailer.

2. Equipment according to claim 1 wherein the saw bench comprises a rotatable circular saw blade driveably connected to the power take off shaft of the tractor.

3. A mobile saw bench comprising:

means for defining an upper support surface for supporting an object to be cut and ground engaging means extending downwardly from the bench for supporting the saw bench in an operative position on the ground with the support surface oriented in a generally horizontal plane and spaced an appropriate distance above the ground for cutting of an object supported thereon, a rotatable saw blade rotatively mounted on the bench and projecting through said support surface, a front wall which includes a tractor attachment means fixed to said front wall for attachment to a three point linkage of a tractor, by which attachment the saw bench can be lifted vertically relative to the tractor, an input drive means including a drive shaft extending through the said front wall for connection to a power take off shaft of the tractor, and transmitting means for connecting the drive shaft with the saw blade for effecting driving of the saw blade from the power of the tractor via the drive shaft, and a rear wall opposed to the front wall and having fixed thereto an attachment means for connecting the saw bench to a trailer located rearwardly thereof, such that the power of the tractor can be relayed through the saw bench to pull the trailer therebehind.

4. A mobile saw bench according to claim 3, wherein the tractor means is located transversely off center at the front end of the bench, and the rear attachment means is located at the rear end of the saw bench opposite to the said tractor attachment means.

5. A mobile saw bench according to claim 3, further comprising a brake for said circular saw blade.

6. A mobile saw bench according to claim 4, said saw blade being parallel to the front and rear walls and located transversely off center in a direction opposite from the said attachment means.

7. A mobile saw bench according to claim 3, said saw blade being parallel to the front and rear walls.

8. A mobile saw bench according to claim 7, said saw blade being located centrally between the front and rear walls and off center transversely.

* * * * *